United States Patent [19]

Ernst

[11] Patent Number: 4,862,782

[45] Date of Patent: Sep. 5, 1989

[54] TURRET PUNCH PRESS TOOL ASSEMBLY

[76] Inventor: Robert E. Ernst, 72 Watergate Dr., South Barrington, Ill. 60010

[21] Appl. No.: 188,838

[22] Filed: May 2, 1988

[51] Int. Cl.[4] ..... B26F 1/04

[52] U.S. Cl. ..... 83/552; 83/588; 83/635; 83/685; 83/691; 83/698; 83/140; 83/954

[58] Field of Search ..... 83/126, 140, 552, 684–689, 83/691, 635, 588, 698, 926 G

[56] References Cited

U.S. PATENT DOCUMENTS

| | | | |
|---|---|---|---|
| 1,977,795 | 10/1934 | Gray | 83/635 |
| 2,580,366 | 12/1951 | Smith | 83/698 |
| 3,079,824 | 3/1963 | Schott | 83/140 |
| 3,114,280 | 12/1963 | Schott | 83/140 |
| 3,137,193 | 6/1964 | Whistler, Sr. et al. | 83/698 |
| 3,342,091 | 9/1967 | Schott et al. | 83/140 |
| 3,527,130 | 9/1970 | Knehans | 83/522 |
| 3,935,772 | 2/1976 | Demus et al. | 83/140 |
| 4,171,656 | 10/1979 | Gargrave | 83/698 |
| 4,257,292 | 3/1981 | Faull | 83/685 |

*Primary Examiner*—Frank T. Yost
*Assistant Examiner*—Scott A. Smith

[57] ABSTRACT

A punch and die pair for turret punch presses including a punch guide with a punch holder slidable therein having a small replaceable punch insert locked axially and rotationally in the punch holder.

16 Claims, 3 Drawing Sheets

TURRET PUNCH PRESS TOOL ASSEMBLY

BACKGROUND OF THE INVENTION

Turret-type machine tool metal working punch presses have been in use for many years and have enjoyed significant commercial success because they dramatically reduce the punching time in cases where multiple punching operations are performed on a single workpiece. And with the advent of numerical controls for these turret punch presses, the total workpiece punching time has been decreased significantly further.

In many turret-type punch presses, the tool pair, i.e., the punch and the die, frequently include a punch guide mounted for limited reciprocal motion within the turret and biased into the turret by a coil compression spring. This guide serves to: (a) clamp the workpiece down against the die which is mounted in the turret under the workpiece; (b) guide the punch itself which is reciprocably mounted in the guide, and (c) strip any excess material from the punch as the punch withdraws from the workpiece into the forward end of the guide.

Typically, the punch is an elongated cylindrical body having a reduced inner end that treadedly receives a spring seat for a coil compression stripper spring that biases the punch away from the work into the guide. The forward end of the punch is also reduced and defines the metal cutting shearing surfaces, and the shape of this end of the punch, while sometimes merely circular, frequently has a non-circular configuration of practically any shape desired.

If the punch in these prior designs needs replacing because of tip wear or breakage, it is necessary to withdraw the entire tool assembly from the turret which requires some disassembly, and then remove the old punch from the guide by unthreading the stripper seat from the end of the punch and then removing the punch and replacing it and reassembling it into the guide, and replacing the resulting assembly back in the turret. The entire broken or worn punch is then discarded. The punch itself is a completely machined part including a central guide portion with frusto-conical transitions on both ends, a reduced inner stem portion, with threads at the proximal end. For this reason the punches are quite costly and because replacement is frequent, it adds significantly to the resulting part cost. Furthermore, the punches are usually hardened by heat treating, and the rather large size of the punches results in a substantial heat treating cost even though only the tip of the punch requires heat treating.

There have, in the past, been attempts to construct punches in two pieces, that is, a holder and a separate punching element held by a holder, but these attempts have either resulted in a more costly punching assembly or one in which the punching element is not easily replaceable. These prior attempts have also not been applied to punches in turret presses and, furthermore, the guide elements for these prior punches do not guide both the holder and the punching element itself.

In the Smith, U.S. Pat. No. 2,580,366, a punch holder is shown in which a punch is insertable from the rear of the holder and held in position by a back-up rod. This assembly is extremely costly and the punching element itself is difficult to replace because of its rear mount.

The Good, et al., U.S. Pat. No. 2,703,143 shows a punch holder with a forwardly insertable punch held in position by a pair of angularly related set screws in the holder that engage chamfers on both sides of the punching tool. Both set screws must be removed to replace the tool and the tool itself is completely unguided which promotes tool breakage.

The Whistler, Sr., et al., U.S. Pat. No. 3,137,193, shows a two piece punch, but the punch itself is unguided and is essentially as large as the present punch and holder combined and therefore, results in no cost saving.

The Vecchi, U.S. Pat. No. 3,274,878, shows a one piece punch and holder.

The Saladin, U.S. Pat. No. 3,741,056, shows a two piece punch but the punch essentially is the size of the punch and holder combined.

The Stursberg, U.S. Pat. No. 3,763,732, shows essentially a one piece punch similar to the Saladin punch.

The Teeslink, U.S. Pat. No. 4,240,314, the Johnson, U.S. Pat. No. 3,063,319, and the Knehans, U.S. Pat. No. 3,527,130, all show two piece punch assemblies but the punch itself is the size of the prior one piece punches and hence, results in no cost saving whatsoever.

It is a primary object of the present invention to provide a punch assembly for a turret punch press that ameliorates the problems noted above in prior art punch assemblies.

SUMMARY OF THE PRESENT INVENTION

In accordance with the present invention, a turret punch press tool assembly is provided that includes a punch holder slidable in a punch guide and a separate punch tip insert replaceably mounted in an internal bore in the holder, axially and rotationally locked therein with both holder and the insert being supported radially by the guide.

With the advent of this unique punch insert and punch holder combination, a wide variety of rather dramatic advantages follow.

Firstly, when the punch tip insert becomes worn or broken, it is merely necessary to replace the insert, and the punch holder itself is a reuseable element having a far longer useful life. This substantially eliminates the prior art technique of discarding the entire punch when the tip becomes worn or broken. Secondly, this new punch insert can be heat treated without heat treating the punch holder thereby reducing heat treatment costs and more importantly, permitting greater quality control in the heat treating of the tip. Ancillary to this advantage is the capability of the punch insert being constructed of a different material, for example a carbide alloy, than the punch holder.

Furthermore, the punch insert can be aligned with the punch guide after assembly in the guide to compensate for machining errors.

Toward these ends the present punch tip insert has a flat-sided upper end that engages a complementary surface in a bore in the punch holder to rotationally lock the insert in position. Adjacent this flat on the punch insert is an annular recess that receives a transverse locking pin received in an offset bore in the punch holder to axially accurately locate the punch insert in the holder. This pin is accessible and removable through an aligned aperture in the punch guide that permits the punch tip insert to be locked in position after the insert is positioned in a guide opening to align the insert in the guide.

Other objects and advantages of the present invention will appear from the following detailed description.

DETAILED DESCRIPTION OF THE PREFERRED EMBODIMENTS

Figure 1:
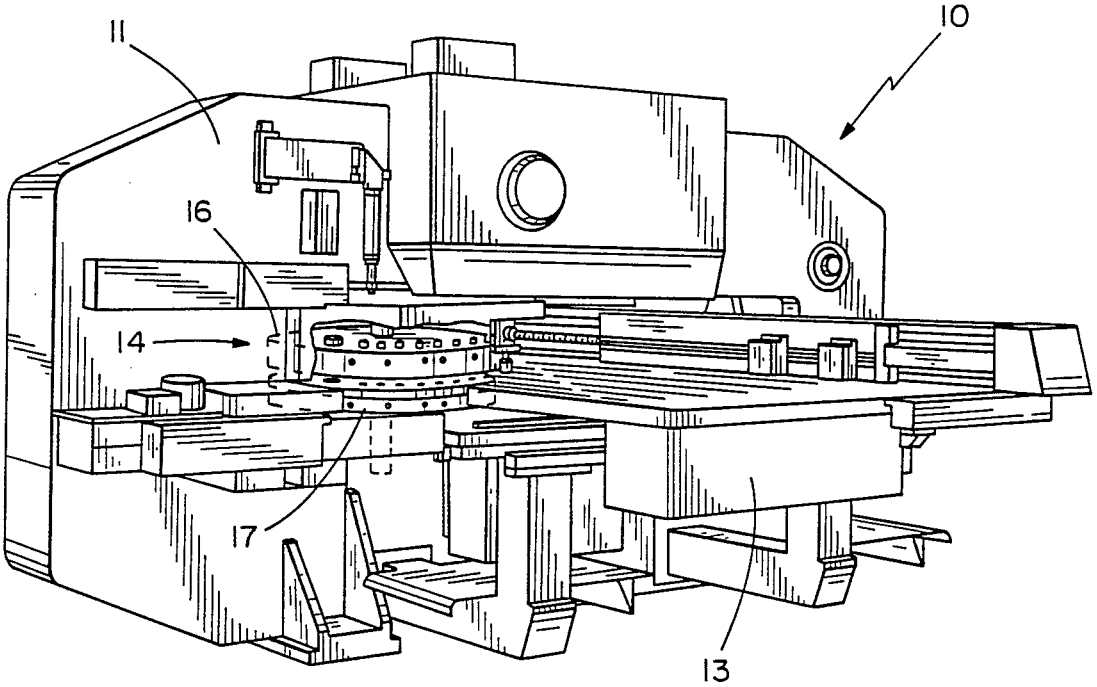
FIG. 1 is a perspective view of a large turret punch press incorporating tool assemblies according to the present invention.

Referring to the drawings, and particularly FIG. 1, a turret punch press 10 is illustrated consisting generally of a closed rectangular frame 11 having a workpiece table and slide assembly 13 horizontally reciprocal thereon that holds sheet stock in a variety of numerically controlled positions relative to a turret assembly 14 mounted for indexing movement on frame 11.

The turret assembly 14 includes an upper turret 16 and a lower turret 17 with the upper turret carrying the punch assemblies and the lower turret carrying the die assemblies. The turrets 16 and 17 are indexed in unison so that the appropriate die remains aligned with its punch assembly and both are under the control of suitable known numerical controls to increase machining productivity.

Figure 2:
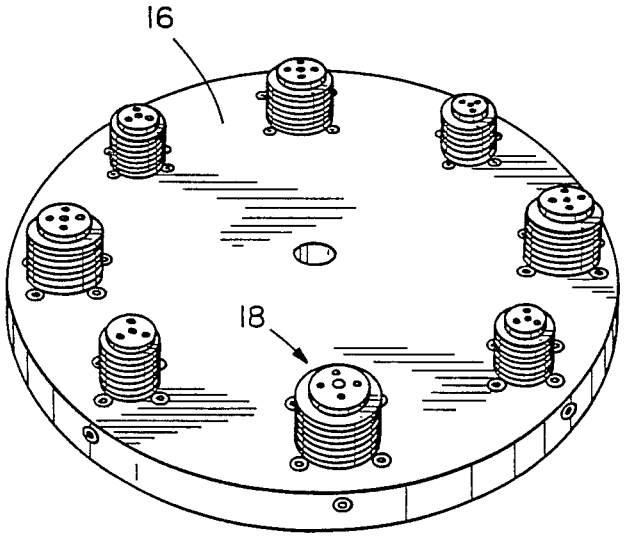
FIG. 2 is an enlarged perspective view of the upper turret of the turret punch press illustrated in FIG. 1.
Figure 3:
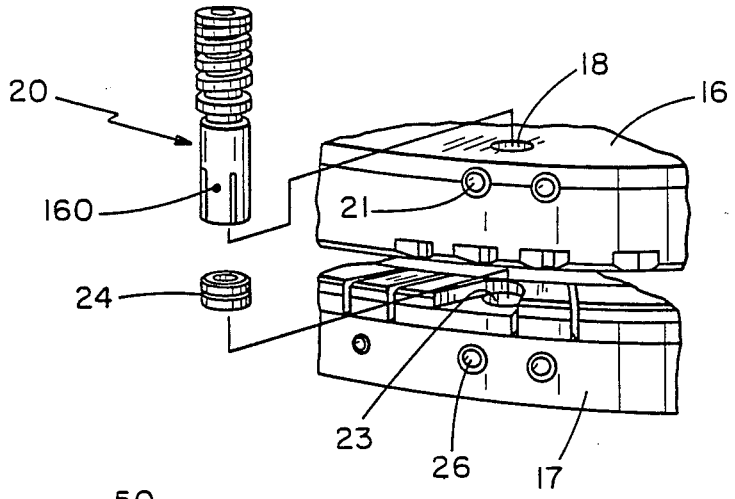
FIG. 3 is a fragmentary view of both upper and lower turrets in the turret press illustrated in FIG. 1, showing the punch and die pair in exploded configuration.

The upper turret 16 is illustrated more clearly in FIG. 2 and is seen to have a plurality of punch assemblies 18 carried thereby, and in FIG. 3 the upper turret 16 is shown in conjunction with lower turret 17, and the upper turret is seen to have a stepped bore 18 therein that receives a punch assembly 20 locked therein by a fastener in radial aperture 21, and the lower turret 17 also has a stepped bore 23 therein adapted to receive a die 24 locked therein by a fastener in radial aperture 26.

Figure 4:
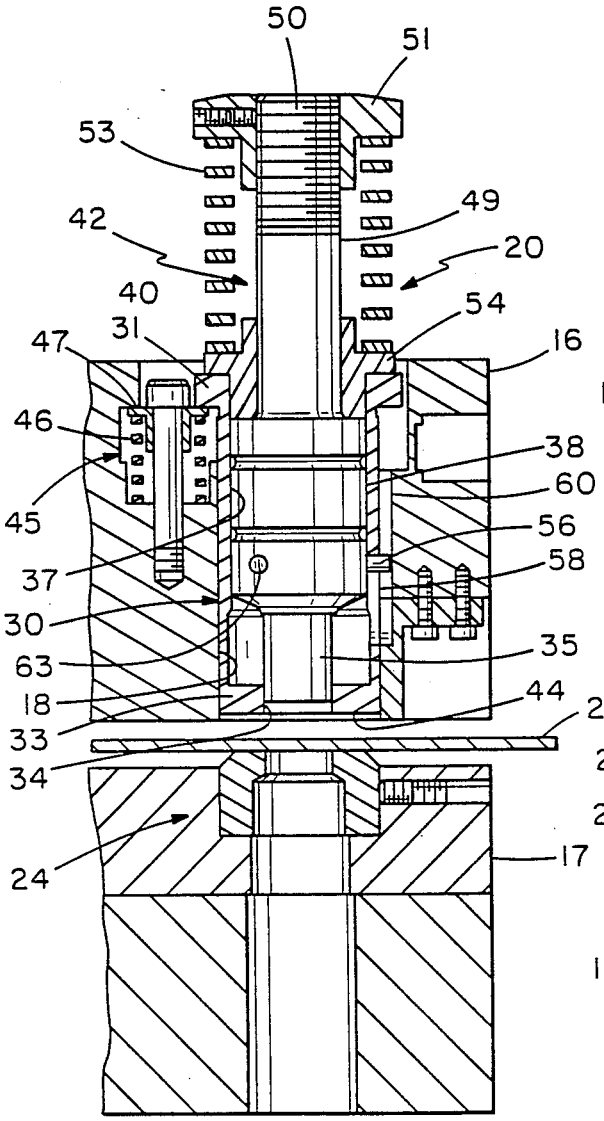
FIG. 4 is an enlarged longitudinal section through one of the tool assemblies illustrated in FIGS. 1 and 3 shown with its punch retracted.
Figure 5:
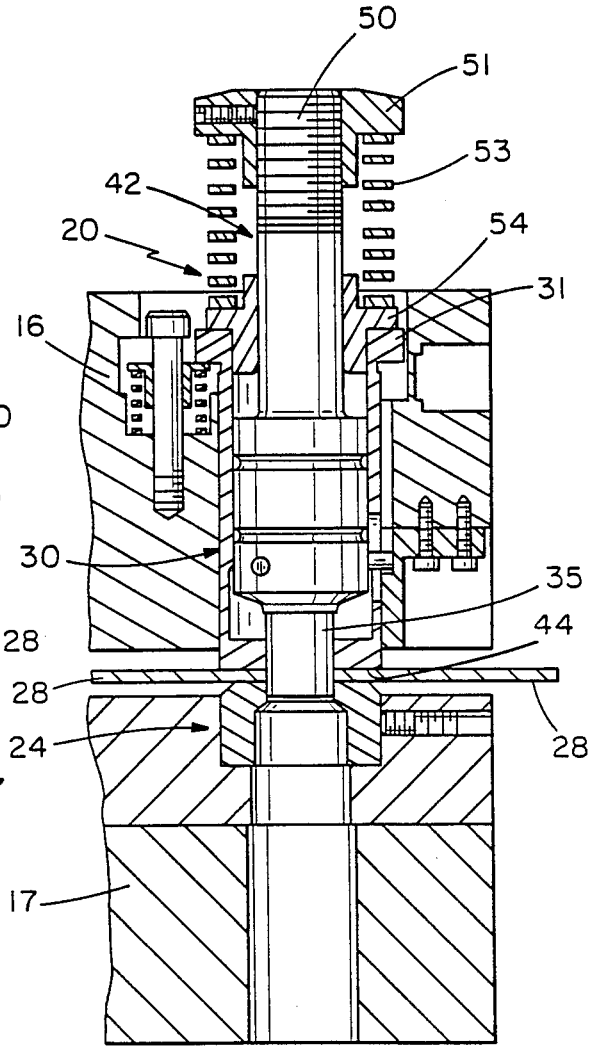
FIG. 5 is a fragmentary longitudinal section similar to FIG. 4 with the same tool assembly shown in its active punching position.
Figure 6:
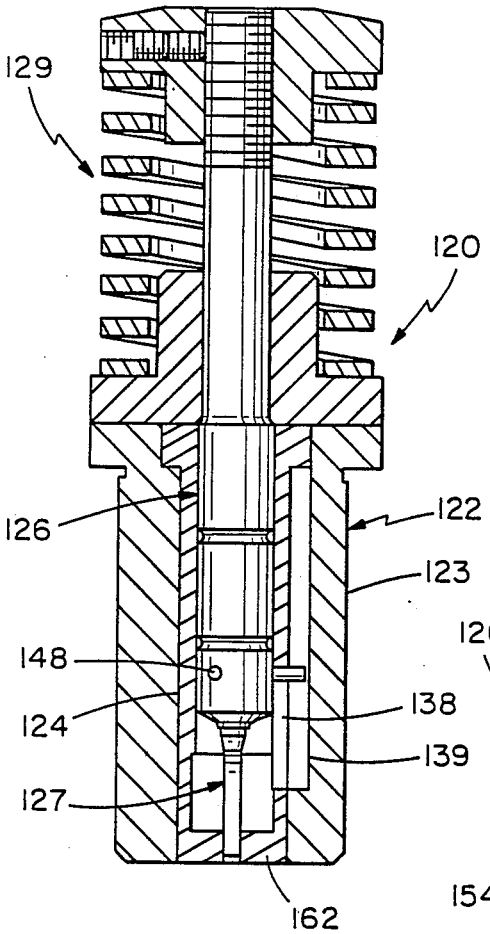
FIG. 6 is a longitudinal section of another punch tool assembly without its associated die with an asymmetrical punch tip insert.

The punch 20 and die 24 are illustrated in greater detail in FIGS. 4 and 5 where they are shown mounted in upper and lower turrets 16 and 17 respectively and also illustrating a workpiece sheet 28 extending between the upper and the lower turrets 16 and 17.

The punch assembly 20 is seen to include a generally annular punch guide 30 mounted for limited reciprocation within turret bore 18, and the guide is seen to include an upper radial flange 31 and a lower transverse tip guide portion 33 having a guiding aperture 34 therein that guidingly receives punch tip insert 35 bearing in mind that the guide aperture 34 has the same configuration as the end of the punch tip insert 35 to guide the tip and absorb radial forces imposed on the tip insert itself. Punch guide 30 has an internal guide bore 37 that guidingly receives an enlarged central integral boss 38 on punch holder 42. Thus, the punch guide 30 has independent guiding surfaces for the punch holder 42 and the punch insert 35.

The punch guide 30, therefore, guides both the punch holder central boss 38 and the punch tip insert 35, and guide lower surface 44 functions as a work clamp when the punch is striken to the position illustrated in FIG. 5.

The punch guide 30 is urged toward its retracted position in turret 16 by a spring assembly 45 that includes a coil compression spring 46 biasing a spring retainer 47 upwardly against guide flange 31.

The punch holder 42 includes the enlarged guide boss 48 and a reduced rear stem portion 49 having a threaded inner end 50 that receives a striker plate spring seat 51 biased upwardly with respect to the turret 16 by a coil compression stripper spring 53 having a lower end seated on a stepped retainer 54 carried by the upper end of the punch guide 30.

The punch holder 42 and hence, the punch insert 35, are angularly fixed with respect to the turret 16 by a cross pin 56 mounted in a radial aperture in punch holder boss portion 38 and extending outwardly therefrom through slot 58 in punch guide 30, and further extending into an axial recess 60 in the turret 16 having a width just slightly greater than pin 56 so that there is no relative angular movement between the punch holder or the punch insert 35 with respect to the turret 16, and at the same time the length of the slot 58 and the recess 60 permits the punch holder to move relative to the guide 30 and also relative to the turret 16.

The punch insert 35 is held in position by a cross pin 63 in a complementary cordal bore in the boss portion 38. Pin 63 axially locks the insert 35 in position as will be described in more detail with respect to the embodiment shown in FIGS. 6 to 11 and also assists in aligning the insert in the guide lower position 44.

As the striker plate 51 is impacted by the striker, punch holder 42 moves downwardly with the punch guide 30 until the punch guide surface 44 contacts the worksheet 28 and clamps it against the upper surface of die 24, and thereafter the punch holder and insert 35 continue their downward movement with the insert sliding through punch guide opening 34 punching worksheet 28 and driving through the mating die 24. Thereafter, stripper spring 53 acts to pull the punch insert 35 back through the worksheet and into the guide opening 34 with a stripping action and the spring assembly 45 moves guide 30 back to its FIG. 4 position.

In the FIGS. 6 to 11 embodiment a somewhat different punch assembly 120 is illustrated that is substantially the same as the punch assembly 20 illustrated in FIGS. 3, 4 and 5 and the shearing edges on the punch have a somewhat different configuration, but suffice it to say that the principles of operation and construction are the same in both except shown in somewhat more detail in FIGS. 6 to 11.

The punch assembly 120 is seen to include a two piece punch guide assembly 122 including bushing 123 and guide insert 124, a punch holder 126 having a punch insert 127 carried thereby, and a stripper spring assembly 129 for retracting the punch holder 126 into the guide assembly 122.

Figure 7:
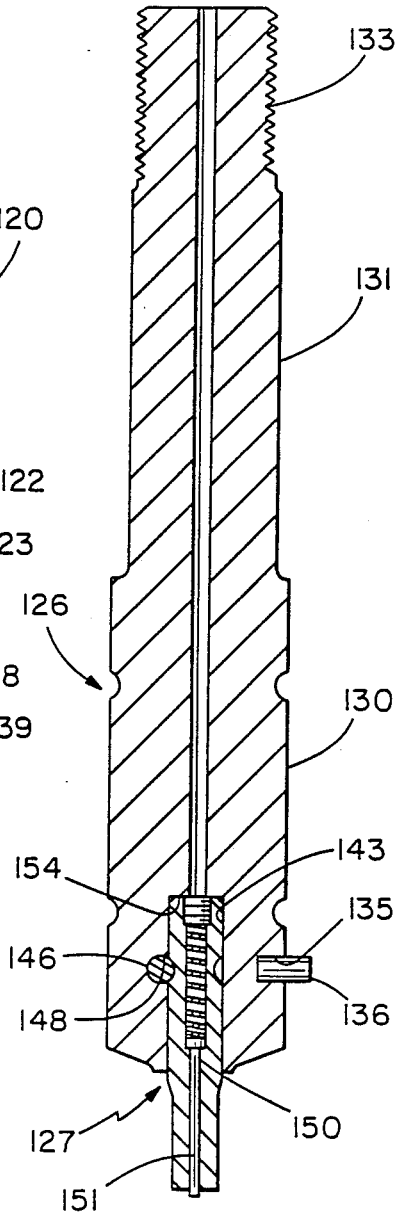
FIG. 7 is an enlarged longitudinal section of the punch holder and punch insert in the assembly of FIG. 6.
Figure 8:
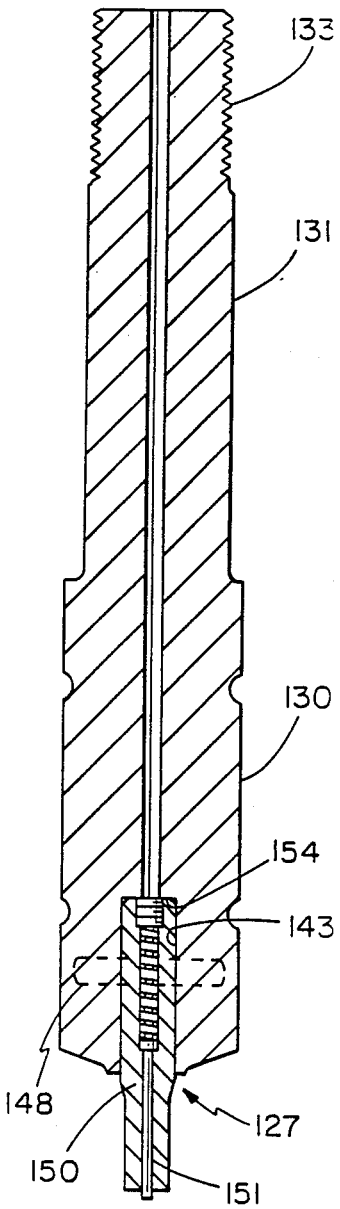
FIG. 8 is a longitudinal section of the punch holder and tip insert illustrated in FIG. 7 rotated 90 degrees therefrom.
Figure 9:
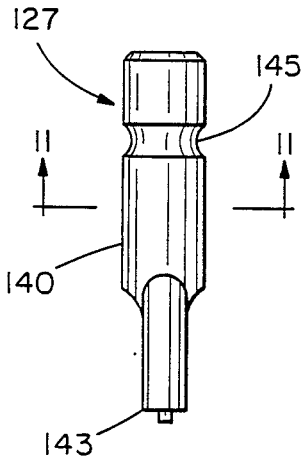
FIG. 9 is an enlarged sub-assembly of the tip insert illustrated in FIGS. 7 and 8.
Figure 10:
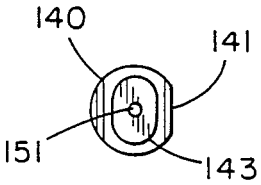
FIG. 10 is a bottom view of the punch tip insert illustrated in FIG. 9.
Figure 11:
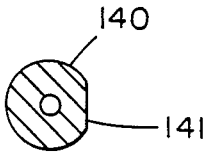
FIG. 11 is a cross-section taken generally along line 11—11 of FIG. 9.

The punch holder 126 is seen in FIGS. 7 and 8 to include an enlarged central guide boss portion 130 and a reduced upper stem portion 131 having a threaded proximate end 133 that receives stripper assembly 129. The boss portion 130 has a radial bore 135 at its lower end that receives a radial pin 136 that extends through guide insert slot 138 into narrow axial passage 139 in guide bushing 123 that serves to angularly lock the punch holder 126 with respect to the guide insert 124 and the guide bushing 123. It should be understood that further means are provided to prevent the bushing 123 from rotation with respect to the turret itself.

The punch tip insert 127 is constructed of a hardened steel or carbide alloy and includes an upper enlarged cylindrical body portion 140 having a flat cordal surface 141 that engages a complementary flat cordal surface in punch holder bore 143 to rotationally lock the punch insert 140 with respect to the holder 126. This rotational locking is essential because punch cutting edge 143 is oval, rather than cylindrical, and thus requires accurate angular orientation for proper punching.

Cylindrical portion 140 also has an annular recess 145 that receives a cross pin 146 extending in an offset cordal through bore 148 in the lower end of the punch holder boss 130 that intersects the bore 143 on an axis perpendicular to the axis of the bore 135. Pin 146 has the same radius as recess 145 and fits snugly therein to accurately axially lock in position the punch insert 127 in the punch holder 126. Pin 146 is driven out of bore 148 to permit the simple replacement of the punch insert 127 when desired. Punch insert 127 also has a slug ejector assembly 150 mounted therein including a spring biased slug ejector pin 151.

The proximal length of the insert 127 is sized so that its proximal or inner end engages the end 154 of holder bore 143 so a major portion of the driving force from the holder passes to the insert 127 along these surfaces and not through the pin 146.

An important aspect of the present invention is that the locking pin 146 is accessible (through openings 160 in the guide. See FIG. 3) through the guide 148 so the insert can be locked, if desired, after the holder and insert are assembled to the guide so the insert's forward end can be aligned properly in forward guide portion 162 (See FIG. 6).

I Claim:

1. A turret punch press assembly, comprising: frame means, an indexible turret mounted for movement on the frame means, a plurality of punch and die pairs mounted in the turret for relative movement with respect to each other, a moveable sheet workpiece support mounted on the frame means for movement relative to the turret, each of said pairs including a punch guide slidably mounted in the turret, means biasing the punch guide toward the turret, a punch holder slidably mounted in the punch guide and having an upper striker impacting end, a coil stripper spring biasing the punch holder into the punch guide and toward the striker, a punch tip insert replaceably mounted in the punch holder and having a punching end adapted to project from the guide upon striker impaction, means for releasably holding the insert axially with respect to the punch holder, means in the guide for laterally and longitudinally angularly guiding the punch holder, and separate means in the guide for directly engaging, guiding and aligning the punch insert and being constructed to longitudinally angularly position the insert with respect to the punch holder to correct misalignment between the insert and the punch holder.

2. A turret punch press assembly, comprising: frame means, an indexible turret mounted for movement on the frame means, a plurality of punch and die pairs mounted in the turret for relative movement with respect to each other, a moveable sheet workpiece support mounted on the frame means for movement relative to the turret, each of said pairs including a punch guide slidably mounted in the turret biasing the punch guide toward the turret, a punch holder slidably mounted in the punch guide and having an upper striker impacting end, a coil stripper spring biasing the punch holder into the punch guide and toward the striker, means for preventing rotation of the punch guide and the punch holder relative to the turret, a punch tip insert replaceably mounted in the punch holder and having a punching end adapted to project from the guide upon striker impaction, means for releasably holding the insert axially with respect to the punch holder, means to releasably and positively angularly lock the punch insert relative to the punch holder, means in the guide for laterally and longitudinally angularly guiding the punch holder, and separate means in the guide for directly engaging, guiding and aligning the punch insert and being constructed to longitudinally angularly position the insert with respect to the punch holder to correct misalignment between the insert and the punch holder.

3. A turret punch press assembly as defined in Claim 2, wherein the punch holder is cylindrical and elongated and has an inner end that threadedly receives an adjustable stripper spring seat, said stripper spring biasing the inner end of the punch holder and having one end engaging the spring seat.

4. A turret punch press assembly as defined in claim 2, wherein the means to prevent rotation of the punch guide and the punch holder relative to the turret includes at least one pin mounted in the punch holder and extending through the punch guide into the turret.

5. A turret punch press assembly as defined in claim 2, wherein the means to axially lock the punch insert into the punch holder includes a recess in the punch insert and a releasable pin extending through the punch holder into the recess in the punch insert.

6. A turret punch press assembly as defined in claim 2, wherein the means to releasably and angularly lock the punch insert in the punch holder includes an asymmetrical upper end on the punch insert and a complementary receiving recess in the forward end of the punch holder.

7. A turret punch press assembly, comprising: frame means, an indexible turret mounted for movement on the frame means, a plurality of punch and die pairs mounted in the turret for releative movement with respect to each other, a moveable sheet workpiece support mounted on the frame means for movement relative to the turret, each of said pairs including a punch guide slidably mounted in the turret, means biasing the punch guide toward the turret, a punch holder slidably mounted in the punch guide and having an upper striker impacting end, a coil stripper spring biasing the punch holder into the punch guide and toward the striker, means for preventing rotation of the punch guide and the punch holder relative to the turret, a punch tip insert replaceably mounted in the punch holder and having a punching end adapted to project from the guide upon striker impaction, said punching end having a non-circular shape, means for releasably holding the insert axially with respect to the punch holder, means to releasably and positively angularly lock the punch insert relative to the punch holder, wherein the punch holder is cylindrical and elongated and has an inner end that threadedly receives an adjustable stripper spring seat, said stripper spring biasing the inner end of the punch holder and having one end engaging the spring seat, means in the guide for laterally and longitudinally angularly guiding the punch holder, and separate means in the guide for directly engaging, guiding and aligning the punch insert and being constructed to longitudinally angularly position the insert with respect to the punch holder to correct misalignment between the insert and the punch holder.

8. A turret punch press assembly, comprising: frame means, an indexible turret mounted for movement on the frame means, a plurality of punch and die pairs mounted in the turret for relative movement with respect to each other, a moveable sheet workpiece support mounted on the frame means for movement relative to the turret, each of said pairs including a punch guide slidably mounted in the turret, means biasing the punch guide toward the turret, a punch holder slidably mounted in the punch guide and having an upper striker impacting end, a coil stripper spring biasing the punch holder into the punch guide and toward the striker, means for preventing rotation of the punch guide and the punch holder relative to the turret, a punch tip insert replaceably mounted in the punch holder and having a punching end adapted to project from the guide upon striker impaction, means for releasably holding the insert axially with respect to the punch holder, means to releasably and positively angularly lock the punch insert relative to the punch holder, wherein the means to prevent rotation of the punch guide and the punch holder relative to the turret includes at least one pin mounted in the punch holder and extending through the punch guide into the turret, means in the guide for laterally and longitudinally angularly guiding the punch holder, and separate means in the guide for directly engaging, guiding and aligning the punch insert and being constructed to longitudinally angularly position the insert with respect to the punch holder to correct misalignment between the insert and the punch holder.

9. A turret punch press assembly, comprising: frame means, an indexible turret mounted for movement on the frame means, a plurality of punch and die pairs mounted in the turret for relative movement with respect to each other, a moveable sheet workpiece support mounted on the frame means for movement relative to the turret, each of said pairs including a punch guide slidably mounted in the turret, means biasing the punch guide toward the turret, a punch holder slidably mounted in the punch guide and having an upper striker impacting end, a coil stripper spring biasing the punch holder into the punch guide and toward the striker, means for preventing rotation of the punch guide and the punch holder relative to the turret, a punch tip insert replaceably mounted in the punch holder and having a punching end adapted to project from the guide upon striker impaction, said punching end having a non-circular shape, means for releasably holding the insert axially with respect to the punch holder, means to releasably and positively angularly lock the punch insert relative to punch holder, wherein the means to angularly lock the punch insert in the punch holder includes an asymmetrical upper end on the punch insert and a complementary receiving recess in the forward end of the punch holder, means in the guide for laterally and longitudinally angularly guiding the punch holder, and separate means in the guide for directly engaging, guiding and aligning the punch insert and being constructed to longitudinally angularly position the insert with respect to the punch holder to correct misalignment between the insert and the punch holder.

10. A turret punch press assembly, comprising: frame means, an indexible turret mounted for movement on the frame means, a plurality of punch and die pairs mounted in the turret for relative movement with respect to each other, a moveable sheet workpiece support mounted on the frame means for movement relative to the turret, each of said pairs including a punch guide slidably mounted in the turret, means biasing the punch guide toward the turret, a punch holder slidably mounted in the punch guide and having an upper striker impacting end, a coil stripper spring biasing the punch holder into the punch guide and toward the stripper, means for preventing rotation of the punch guide and the punch holder relative to the turret, a punch tip insert replaceably mounted in the punch holder and having a punching end adapted to project from the guide upon striker impaction, said punching end having a non-circular shape, means for releasably holding the insert axially with respect to the punch holder, means to releasably and positively angularly lock the punch insert relative to the punch holder, wherein the means to releasably axially lock the punch insert in the punch holder includes a recess in the punch insert and a releasable pin extending through the punch holder into the recess in the punch insert, means in the guide for laterally and longitudinally angularly guiding the punch holder, and separate means in the guide for directly engaging, guiding and aligning the punch insert and being constructed to longitudinally angularly position the insert with respect to the punch holder to correct misalignment between the insert and the punch holder.

11. A punch and die pair for a punch press comprising: frame means, a punch guide slidably mounted in the frame means, means biasing the punch guide toward the frame means, a punch holder slidably mounted in the punch guide and having an upper striker impacting end, a coil stripper spring biasing the punch holder into the punch guide and toward the striker, means for preventing rotation of the punch guide and the punch holder relative to the frame means, a punch tip insert replaceably mounted in the punch holder and having a punching end adapted to project from the guide upon striker impaction, said punching end having a non-circular shape, means for releasably holding the insert axially with respect to the punch holder, means to releasably and positively angularly lock the punch insert relative to the punch holder, means in the guide for laterally and longitudinally angularly guiding the punch holder, and separate means in the guide for directly engaging, guiding and aligning the punch insert and being constructed to longitudinally angularly position the insert with respect to the punch holder to correct misalignment between the insert and the punch holder.

12. A punch and die pair for a punch press as defined in claim 11, wherein the means to prevent rotation of the punch guide and the punch holder relative to the frame means includes at least one pin mounted in the punch holder and extending through the punch guide into the frame means.

13. A punch and die pair for a punch press as defined in claim 11, wherein the means to angularly lock the punch insert in the punch holder includes an asymmetrical upper end on the punch insert and a complementary receiving recess in the forward end of the punch holder.

14. A punch and die pair for a punch press as defined in claim 11, wherein the means to releasably and axially lock the punch insert in the punch holder includes a recess in the punch insert and a releasable pin extending through the punch holder into the recess in the punch insert.

15. A turret punch press assembly, comprising: frame means, an indexible turret mounted for movement on the frame means, a plurality of punch and die pairs mounted in the turret for relative movement with respect to each other, a moveable sheet workpiece support mounted on the frame means for movement relative to the turret, each of said pairs including a punch guide slidably mounted in the turret, means biasing the punch guide toward the turret, a punch holder slidably mounted in the punch guide and having an upper striker impacting end, a coil stripper spring biasing the punch holder into the punch guide and toward the striker, means for preventing rotation of the punch guide and the punch holder relative to the turret, a punch tip insert replaceably mounted in the punch holder and having a punching end adapted to project from the guide upon striker impaction, means for releasably holding the insert axially with respect to the punch holder, and means for permitting replacement of the punch tip insert in the punch holder without removing the punch holder from the guide.

16. A turret punch press assembly as defined in claim 2, wherein the punch holder and insert are separately guided in the punch guide.

* * * * *